US005993113A

United States Patent [19]

Darling

[11] Patent Number: 5,993,113

[45] Date of Patent: Nov. 30, 1999

[54] FLOOD BARRIER SYSTEM

[76] Inventor: Robert Darling, 16236 Minnesota Ave., Paramount, Calif. 90723

[21] Appl. No.: 09/038,558

[22] Filed: Mar. 11, 1998

[51] Int. Cl.[6] ..... E02B 7/08; E02B 13/00

[52] U.S. Cl. ..... 405/114; 405/16; 405/21; 405/52; 405/91

[58] Field of Search ..... 405/114, 115, 405/91, 52, 15, 16, 19–21, 29–31

[56] References Cited

U.S. PATENT DOCUMENTS

| | | | |
|---|---|---|---|
| 1,902,741 | 3/1933 | Weber | 405/114 X |
| 3,213,628 | 10/1965 | Serota | 405/114 X |
| 3,886,751 | 6/1975 | Labora | 405/107 |
| 3,974,655 | 8/1976 | Halpern et al. | 405/115 |
| 4,692,060 | 9/1987 | Jackson | 405/91 X |
| 4,869,617 | 9/1989 | Chiodo | 405/114 X |
| 5,059,065 | 10/1991 | Doolaege | 405/115 |
| 5,865,564 | 2/1999 | Miller et al. | 405/21 X |

*Primary Examiner*—Dennis L. Taylor
*Attorney, Agent, or Firm*—Christie, Parker & Hale, LLP

[57] ABSTRACT

A flood barrier having water fillable elongate tube portions and cylindrical water fillable junction portions. Water fill inlets, water drain outlets, air relief valves, and anchors are formed on the elongate tube portions and cylindrical junction portions. Ends of the elongate tube portions are held in watertight contact with the cylindrical junction portions with straps threaded through the anchors. Saddle portions prevent the elongate portion from rolling. The saddle portion has two loops with tubes placed in the loops, and the elongate tube portion is placed on the saddle portion with tubes straddling the elongate tube portion.

15 Claims, 3 Drawing Sheets

FLOOD BARRIER SYSTEM

BACKGROUND OF THE INVENTION

1. Field of Invention

The invention relates generally to the field of flood barriers and more particularly to a readily transportable flood barrier system having elongate water fillable tubes adapted for detachable and water tight attachment to anchor portions, and anti-roll saddles for use therewith.

BACKGROUND OF THE INVENTION

2. Description of the Prior Art

Despite many technological advancements in the area of meteorology, scientists are still unable to accurately predict weather beyond several days. Thus, the need to deal with heavy rains and its often accompanying flooding on short notice remains important.

In addition to permanent and temporary levees, the sandbag has long been a fixture in flood control. While the old burlap bag has been largely replaced with synthetic fiber or plastic bags, using sandbags to build flood control barriers remains hard, time consuming, and labor intensive work. Sand or other fill material must either already be available on site or trucked in. Many volunteers with shovels must be on hand to fill and stack the sandbags. If the sandbags are not stacked together tightly enough, the water leaks through. Indeed, images of teams of volunteers braving storms to fill and stack sandbags against rising water levels is a mainstay in television storm disaster coverage. Unfortunately, many times, there are not enough volunteers or sandbags, and the flood breaches the barrier.

In view of the known problems with sandbags, there have been other attempts to devise alternative flood control systems. For example, U.S. Pat. No. 5,125,767 to Dooleage discloses a temporary flood control barrier comprising a pair of cylindrical bags within another bag to prevent the bags from rolling. Dooleage discloses a filler spout and vent tube as well.

U.S. Pat. No. 4,555,201 to Paoluccio discloses a method and triangular shaped sediment dike apparatus for containing a mixture of liquids and solids to form a dike.

U.S. Pat. No. 5,158,395 to Holmberg discloses an erosion control foundation mat upon which sand or concrete filled tubes are placed. The structure has T-shaped tube structure with built in side pockets to prevent rolling.

U.S. Pat. No. 5,040,919 to Hendrix discloses a triangle-shaped flood control barrier, that is filled with water via inlets. The gussets formed inside the barrier help retain the triangle shape.

U.S. Pat. No. 3,246,474 to Mesnager discloses water filled barriers that are anchored at an end to act as a breakwater.

U.S. Pat. No. 3,191,386 discloses a water-filled barrier in the form of a dam structure.

U.S. Pat. No. 4,799,821 to Brodersen discloses a method and water filled tube with easily sealable ends (which are self-sealing when tied off) to act as a hazardous materials spill barrier.

U.S. Pat. No. 5,669,732 to Truitt discloses self-closing and interlocking sandbags and a process for filling them. This system, using a sand blower and dump truck permits fast filling of elongate sandbag sections, which can be joined together.

Notwithstanding these prior art attempts at providing temporary flood control barriers, these devices have shortcomings, including that they either require filling with fill material such as sand, and are not readily attachable together to form a barrier having the necessary height, length, and perimeter orientation (for example, around a house or other structure.)

SUMMARY OF THE INVENTION

One object of the invention is to provide a readily transportable flood barrier system that can be easily delivered to a site and set up with few people.

Another object of the invention is to provide a flood barrier system that uses water as its fill material, and thus avoids the need for sand or other material which may not or may not be readily available and must be discarded after the danger of flooding has passed.

Yet another object of the invention is to provide a system of elongate water fillable tubes that are easily connectable together with junction members, to allow forming a flood barrier of any desired perimeter contours.

These and other objects of the inventions are achieved by providing generally cylindrical water fillable junction portions and elongate water fillable tube sections. Ends of the elongate water filled tubes are forced into tight contact with the junction members, and are restrained in place with straps. Because of the cylindrical shape of the junction members, the elongate water filled tubes can be joined together with the junction members at any desired angle, to form a flood barrier having the necessary perimeter contour. The elongate water fillable tubes and generally cylindrical water fillable members have a plurality of inlets and outlets designed to be quickly filled by fire hoses and the like. Since the unfilled elongate tubes and junction members are relatively lightweight, few people are needed to position them and fill them. In contrast, with conventional sandbags, sand (or sandbags) must be delivered to the site, filled by many people, and positioned by many people. All of this is extremely labor intensive, time consuming, and messy (the sand and sandbags must later be cleaned up.) In contrast, with the instant invention, the required number of units can be easily delivered to the site, set up with few people, and quickly filled with water. After the flood danger is over, the water in the flood barrier can be easily and safely drained away, and the flood barrier can be folded up and stored for future use.

DETAILED DESCRIPTION OF THE PREFERRED EMBODIMENTS

Figure 1:
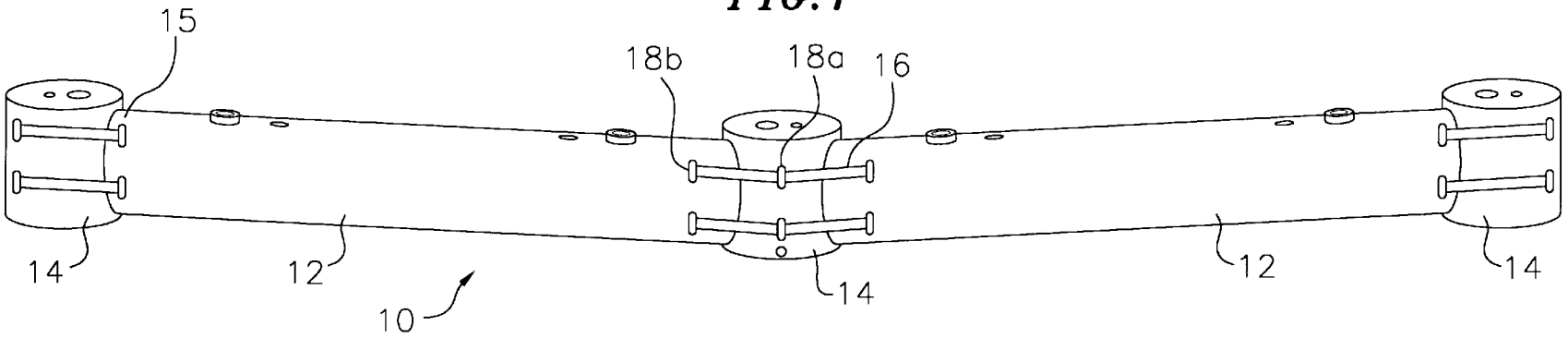
FIG. 1 is a perspective view of the flood barrier of the invention.
Figure 4:
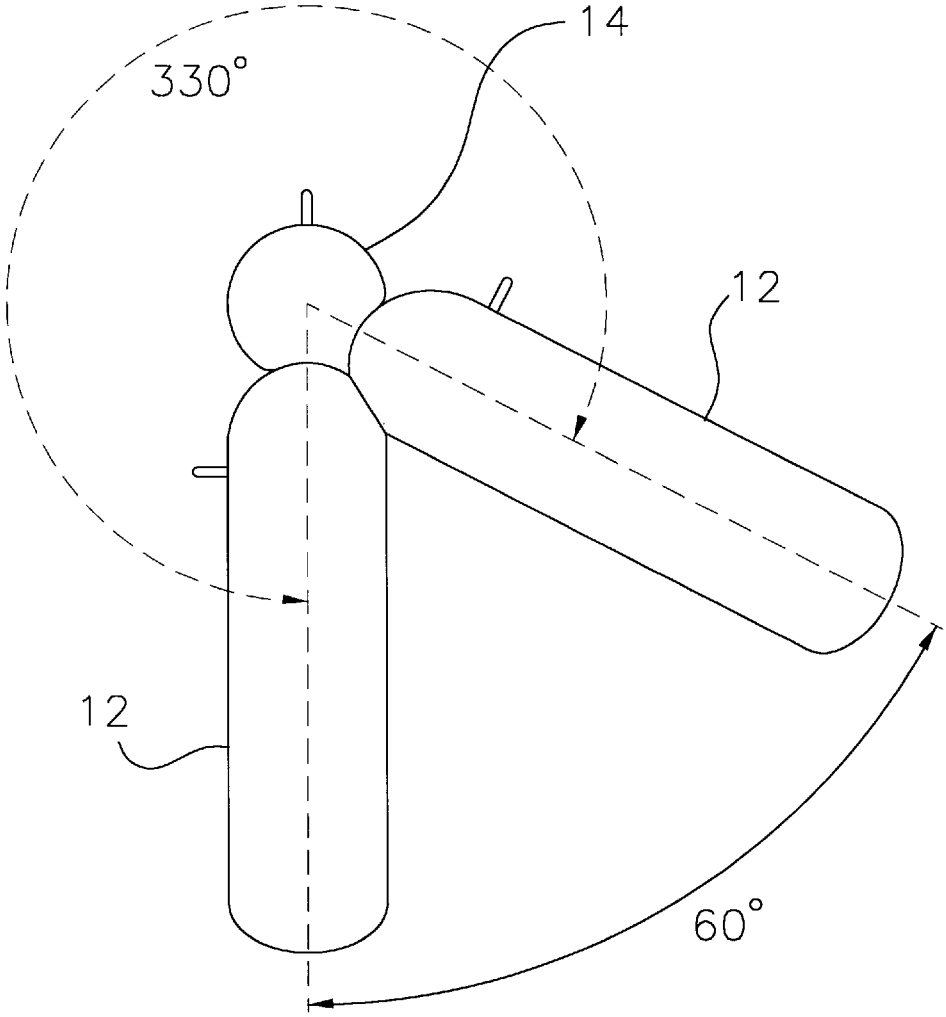
FIG. 4 is a top view showing an anchor with two elongate tubes positioned theretogether.

Referring to FIG. 1, the barrier system 10 of the invention includes elongate water fillable tubes 12 that are easily connectable together with water fillable junction members portions or junction 14, to allow a barrier having the desired layout to be easily formed. Ends 15 of elongate water filled tubes 12 are forced into tight contact with junction portions members 14, and are retained in place with detachably attachment means, such as straps 16 junction markers connected to anchor portions 18*a* affixed to the junction members 14 and elongate tube anchor member 18*b* on to end regions 20 of elongate tubes 12. Water fillable junction members 14 can assume a variety of shapes, but the inventor has found that a generally cylindrical shape functions well, because elongate water filled tubes 12 can be pushed into joining contact together with junction members 14 at a variety of angles, thus allowing elongate tubes 12 to form a flood barrier 10 having a desired outline. This is shown in FIG. 4. Elongate tubes 12 and junction portions 14 are stopped together prior to being completely filled with water. As water fills the elongate tube 12 and junction portions 14, they expand into tight and generally leak-resistant contact with each other. The barrier 10 of the invention will conform to the ground's contour and form a water-tight seal.

Figure 2:
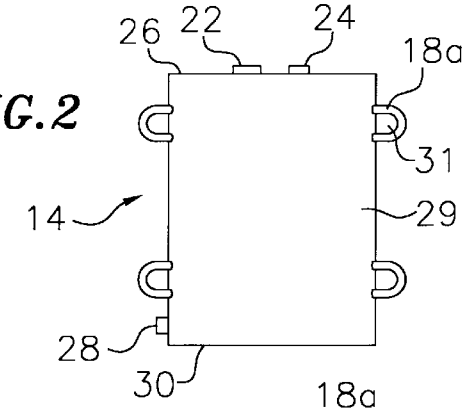
FIG. 2 is a side view of the junction member.
Figure 3:
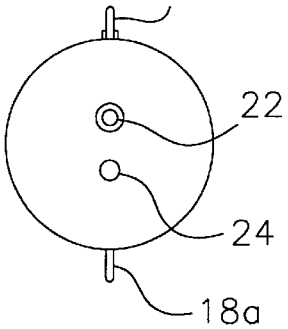
FIG. 3 is a top view of the junction member.

Referring to FIGS. 2 and 3, water fillable junction portion 14 has a water inlet 22 (such as a PVC ball valve with a female threaded inlet for connection to a water hose) and an air relief valve 24 at a generally flat top portion 26 thereof, and at least one water outlet or drain plug 28 near its flat bottom 30, a perimeter sidewalls 29. Water fillable junction member 14 is designed to be quickly filled through water inlet 22 by fire hoses (for very large capacity barriers), garden hoses (for smaller capacity systems), and the like. For example, 1½" and 2½" diameter valves are compatible with standard fire department hoses. For situations where there is no potable water available, floodwater itself can be used to fill the barriers, for example by using a portable pump. Air relief valve 24 permits rapid filling by venting off air, and is closed once water fillable junction member 14 is filled with water. Junction member anchor portions 18*a* are fixed on perimeter wall 32 of water fillable junction member 14 and are preferably formed with two vertically oriented pairs offset at about 180° from each other. Drain plug or drain plugs 28 are preferably oriented generally vertically with junction member anchor portions 18*a* so that they may be accessed for drainage of water filled junction member 14 after they are no longer needed. Anchors 18*a* preferably have an aperture 31 formed therethrough for passage of a rope or strap. As noted above, water fillable junction member 14 are preferably generally cylindrical in shape to allow the appropriate angle of junction between anchor 14 and elongate tubes 12 to be set. (See FIG. 4). Junction member 14 is formed of a flexible thermoplastic-coated fabric that can include, for example, nylon, polyester, and Kevlar®. The Cooley Company, of Pawtucket, R.I., produces such materials. The fabric can be thermally welded with a relatively wide and strong lap seam to form the desired shape. In small and light duty tubes, fabric reinforced fabric can be replaced with unreinforced plastic material.

Figure 5:
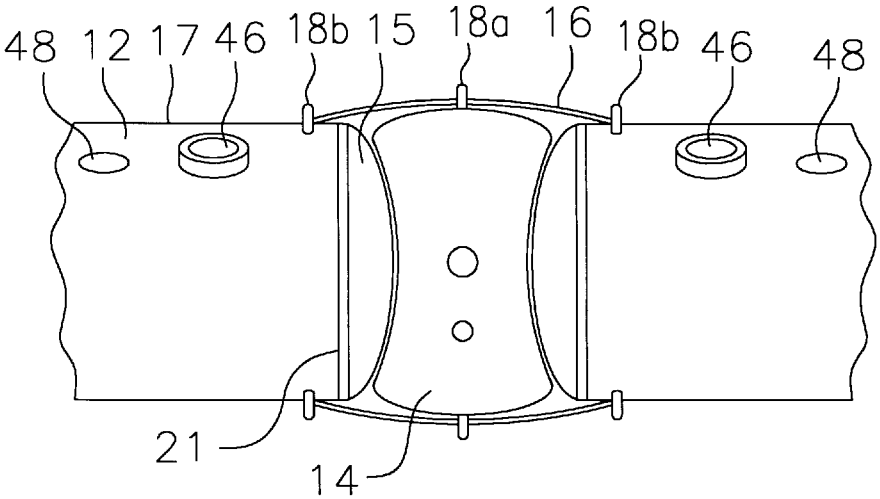
FIG. 5 is a top plan view showing the generally liquid tight seal formed between the junction member and elongate tubes.

FIG. 4 is a top view showing a junction member 14 with two elongate tubes 12 positioned together at a desired angular orientation. FIG. 5 is a top plan view showing the generally liquid tight seal formed between the junction member 14 and elongate tubes 12 joined together with straps 16 through apertures 31 in anchors 18*a* and 18*b*. Elongate water fillable tubes comprises end walls 15 and a perimeter sidewall 17, with the end walls 15 sealed with lap seams 21 to the side walls 15. As with junction members 14, elongate tubes 12 have at least one, and preferably a plurality of water inlets 46 and air relief valve 48 formed on perimeter side walls 17 of tube 12.

Figure 6:
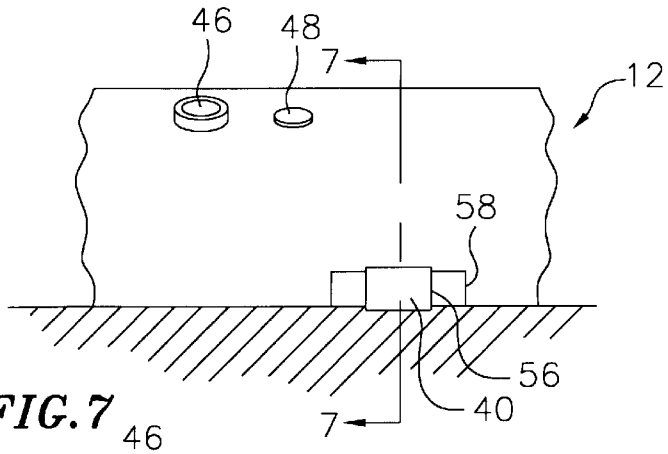
FIG. 6 is a side view of the elongate tube and anti-roll saddle.
Figure 8:
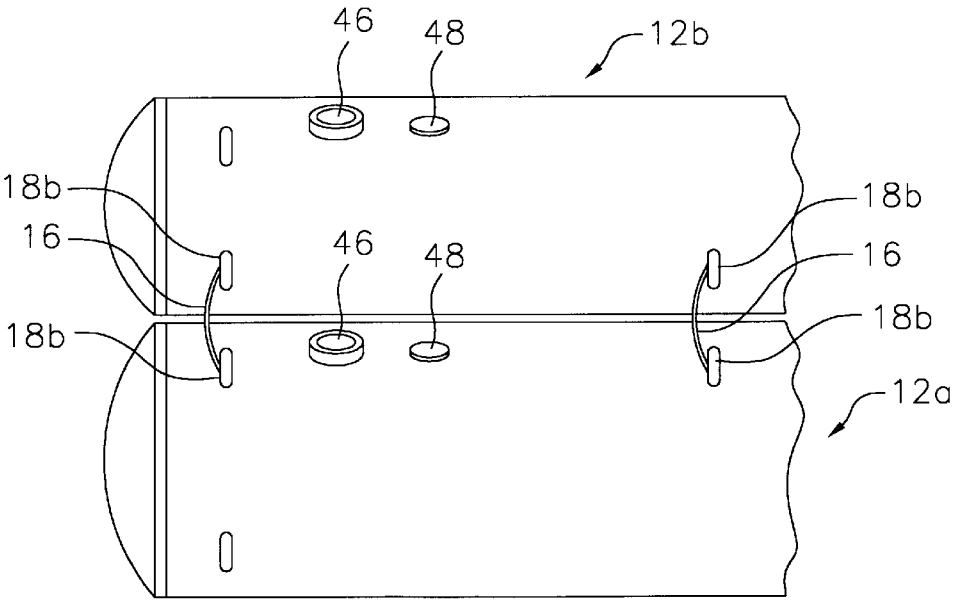
FIG. 8 is a partial side view of the tubular portions and junction markers stacked on each other.

FIG. 6 is a side view of one elongate tube 12 seated on anti-roll saddles 40. In order to allow optional stacking of multiple elongate tubes 12*a* and 12*b* on top of each other (see FIG. 8), water inlets 46 are preferably located above a mid-line of elongate tubes near ends of elongate tube 12, but not on top of tube 12. Anchors 18*b* are formed near end walls 15 and along intermediate portions of tube 12 (see FIG. 1.) These intermediately located anchors 18*b* can be used, for example, to help retain saddles 40 in place. Elongate tubes 12 can have a variety of diameters and lengths, so that any number of desired perimeters can be protected. If desired, elongate tubes 12 can be stacked (optionally with saddles 40 placed therebetween and strapped together) to form a barrier higher than provided by a single row of elongate tubes 12, as shown in FIG. 8.

Figure 7:
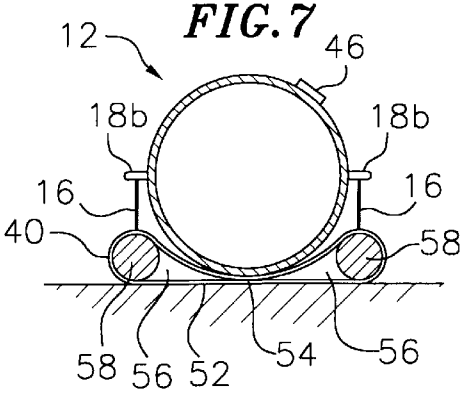
FIG. 7 is a cross-sectional view through view lines 7—7 of FIG. 6.

Referring to FIG. 7, a cross-sectional view through view lines 7—7 of FIG. 6 is shown. This view shows elongate tube 12 seated on an optional saddle 40. Saddle 40 comprises a flat loop of material 52 that is joined at a mid-portion 54 (like a bow tie), to form two openings 56. Small water fillable cylindrical tubes 58 are placed into these two openings. Alternately, foam material, such as "Ethafoam" offered by the DOW Chemical Company, can be used. Elongate tubes 12 are placed over mid-portion 54 of saddle, with the two cylindrical saddle tubes 58 straddling elongate tube 12 on both sides. Saddle 40 prevents rolling of elongate tube 12. For relatively short lengths of elongate tube, e.g. four or eight foot lengths, rolling is not problematic. For longer lengths and larger diameter elongate tubes 12, use of saddles 40 becomes more important. The inventor has found that for elongate tubes 12 having a diameter of about 36 inches, cylindrical saddle tube members 58 having a diameter of about eight inches and about 12 to 30 inches long functions well. However, other dimensions can be used as well.

Since unfilled elongate tubes 12 and junction members 14 are relatively lightweight, few people are needed to position them and fill them with water, and then drain them and store them after the need passes. In contrast, with conventional sandbags, sand (or sandbags) must be delivered to the site, filled by many people, and positioned by many people. All of this is extremely labor intensive, time consuming, costly and messy (the sand must latter be cleaned up.) In contrast, with the instant invention, the required number of units can be easily delivered to the flood site (such as carried by hand, by truck, or helicopter), set up with few people, and quickly filled with water. After the flood danger is over, the flood barrier can be drained, and then stored for future use. No messy sandbags need be cleaned up.

The drawings and the foregoing description are not intended to represent the only form of the invention in regard to the details of its methodology and manner of operation. In fact, it will be evident to one skilled in the art that modifications and variations may be made without departing from the spirit and scope of the invention. Although specific terms have been employed, they are intended in a generic and descriptive sense only and not for the purpose of limitation.

I claim:

1. A flood barrier comprising;

at least one water fillable elongate tube portion having sidewalls and two end walls, water fill means, water drain means, and tube portion anchor means formed thereon;

at least one water fillable junction portion having a perimeter sidewall, a top portion and a bottom portion, water fill means, water drain means, and junction portion anchor means; and means for bringing end walls of the water fillable elongate tube portion into tight contact with the perimeter sidewalls of water fillable junction portion.

2. The flood barrier of claim 1 wherein the water fillable junction portion is generally cylindrical in shape and the end portions of the water fillable elongate tube portion protrude convexly outwardly.

3. The flood barrier of claim 1 wherein the water fillable elongate tube portion and water fillable junction portion further include air relief valves to vent air during filling of the elongate tube portion and water fillable junction portion with water.

4. The flood barrier of claim 1 wherein the means for compressing end walls of water fillable elongate tube portion into contact with perimeter sidewalls of water fillable junction portion comprises straps adapted for engagement with the tube portion anchor means and junction portion anchor means.

5. The flood barrier of claim 1 wherein the water fill means comprises a valve with a threaded inlet for connection to a water fill hose.

6. The flood barrier of claim 1 further comprising means to prevent the elongate tube portion from rolling.

7. The flood barrier of claim 6 wherein the means to prevent the elongate tube portion from rolling comprises a saddle portion having a band of material fineal in a middle to form two loops, and tubes adapted to fit into the loops, wherein in use the elongate tube portion is placed on the saddle portion straddling the two loops with water filled tubes.

8. The flood barrier of claim 4 wherein the elongate tube anchor means comprise protrusion members with apertures formed therein permanently affixed to perimeter side walls of the elongate tube near the end walls and also along intermediate portions of the elongate tube, and the junction portion anchor means comprise protrusion members with apertures formed therein permanently affixed to the perimeter sidewall of the junction portion.

9. The flood barrier of claim 8 wherein at least one pair and preferably two pairs of elongate tube anchor means are formed adjacent each end of the elongate tube, and two pairs of junction portion anchor means are positioned on the junction portion, the junction portion anchor means in each pair being vertically oriented, and the two pairs of junction portion anchor means are located on opposite sides of the junction portion.

10. The flood barrier of claim of claim 1 wherein a plurality of elongate tubular portion and water fillable junctions means are adapted to be stacked and held together with strap means.

11. A flood barrier comprising;

at least one water fillable elongate tube portion having sidewalls and two end walls that protrude convexly outwardly, water fill means, air relief valve means, water drain means, and anchor means formed thereon;

at least one generally cylindrical water fillable junction portion having a perimeter sidewalls, a top portion and a bottom portion, and water fill means, water drain means, air relief valve means, and anchor means, wherein the air relief valves means vent air during filling of the elongate tube portion and water fillable junction portion; and straps adapted for engagement with the anchor means on the water fillable elongate tube portion and water fillable junction portion for bringing end walls of the water fillable elongate tube portion into tight contact with the perimeter sidewalls of water fillable junction portion.

12. The flood barrier of claim 11 wherein the water fill means comprises a valve with a threaded inlet for connection to a water fill hose.

13. The flood barrier of claim 11 further comprising saddle portion to prevent the elongate tube portion from rolling, the saddle portion having a band of material joined in a middle to form two loops, and tubes adapted to fit into the loops, wherein in use the elongate tube portion is placed on the saddle portion straddling the two loops with tubes.

14. The flood barrier of claim 11, wherein the elongate tube anchor means comprise protrusion members with apertures formed therein permanently affixed to perimeter side walls of the elongate tube near the end walls and also along intermediate portions of the elongate tube, and the junction portion anchor means comprise protrusion members with apertures formed therein permanently affixed to the perimeter sidewall of the junction portion.

15. The flood barrier of claim 14 wherein at least one pair and preferably two pairs of elongate tube anchor means are formed adjacent each end of the elongate tube, and two pairs of junction portion anchor means are positioned on the junction portion, the junction portion anchor means in each pair being vertically oriented, and the two pairs of junction portion anchor means are located on opposite sides of the junction portion.

* * * * *